US006284678B1

(12) United States Patent
Kobayashi et al.

(10) Patent No.: US 6,284,678 B1
(45) Date of Patent: Sep. 4, 2001

(54) FORMING BELT FOR MANUFACTURING CONSTRUCTION MATERIALS AND TRANSFER BELT FOR MANUFACTURING CONSTRUCTION MATERIALS

(75) Inventors: Shogo Kobayashi, Shizuoka; Hiroyuki Nagura, Tokyo, both of (JP)

(73) Assignees: Nippon Filcon Co., Ltd.; Kobayashi Engineering Works Ltd.

( * ) Notice: Subject to any disclaimer, the term of this patent is extended or adjusted under 35 U.S.C. 154(b) by 0 days.

(21) Appl. No.: 09/165,119

(22) Filed: Oct. 2, 1998

(30) Foreign Application Priority Data

Oct. 3, 1997 (JP) ..... 9-306286

(51) Int. Cl.[7] ..... D03D 15/00; D03D 11/00

(52) U.S. Cl. ..... 442/207; 442/268; 139/394; 139/411; 139/413; 162/348; 162/351

(58) Field of Search ..... 139/394, 411, 139/413; 162/348, 351; 442/268, 60, 62, 76, 207

(56) References Cited

U.S. PATENT DOCUMENTS 3,858,623 * 1/1975 Lefkowitz ..... 139/425 A
5,077,116 * 12/1991 Lefkowitz ..... 428/141

* cited by examiner

*Primary Examiner*—Elizabeth M. Cole
*Assistant Examiner*—Ula C. Ruddock
(74) *Attorney, Agent, or Firm*—Rader, Fishman & Grauer

(57) ABSTRACT

A forming belt and/or a transfer belt which are belts for a forming part of an apparatus for manufacturing a construction material, prevent stains caused by entry of raw material particles and has excellent rigidity and cleanability.

12 Claims, 5 Drawing Sheets

FORMING BELT FOR MANUFACTURING CONSTRUCTION MATERIALS AND TRANSFER BELT FOR MANUFACTURING CONSTRUCTION MATERIALS

BACKGROUND OF THE INVENTION

1. Field of the Invention

The present invention relates to a forming belt for manufacturing a construction material such as a slate or roof tile and to a transfer belt for manufacturing a construction material.

2. Description of Related Art

A method of manufacturing a construction material such as a slate or roof tile which is a known technology is to prepare a slurry by dissolving a raw material such as cement, pearlite, gypsum, aggregate, organic fiber, inorganic fiber or asbestos in water, form it with a forming part, transfer the obtained wet material to a pressing part, press hydrate mold and remove it from a mold.

The types of the forming part are roughly divided into a cylinder type and a fordrinier type. For the formation of a construction material, in a conventional cylinder system, a woven net such as a metal net or the like is typically used as a forming belt for covering a cylinder as in the formation of a cylinder for papermaking. In a fordrinier system, a woven net is not used as a forming belt, but rather a so-called needle felt is used that is formed by needling synthetic fiber vatts on the front and rear of a base woven of monofilament or multifilament yarn so that they cross each other. This is because it is difficult to produce a construction material having a desired thickness or a desired weight, since, unlike the raw material for making paper, the raw materials for construction materials such as a slate or roof tile are mainly very fine powder materials as described above and therefore can leak through the mesh of woven net.

In the cylinder system, a woven net can be used because thin wet materials formed by scooping a raw material with a cylinder are joined together sequentially. However, in the fordrinier system, a construction material having a desired thickness or weight must be formed almost at one time and a large number of forced suction dehydraters are installed, thereby making the use of conventional woven nets impossible because the raw material leaks therethrough.

In a fordrinier type forming part of a machine for manufacturing a construction material, water is removed from a slurry through felt by a forced suction device such as a suction box as described above.

The needle felt has such an advantage that the leakage of the raw material is small and the yield is high because it is finely formed with both its front and rear sides covered with vatts. However, it has a disadvantage in that it is easily stained because the vatts are crowded in the whole direction of the z axis and the raw material can be accumulated inside the felt. Further, when a high-pressure cleaning shower is used to remove stains, the fibers of the vatt are broken and holes are easily formed. Therefore, needle felt has extremely low cleanability. The needle felt also has a serious disadvantage in that it is inferior in elongation rigidity, flexural rigidity and dimensional or attitude stability.

Since construction materials have extremely large weights, great tension must be applied to a forming belt in order to stretch the belt tightly, and the drive roll force must be transmitted so as to enable a forming belt carrying a raw material to travel smoothly.

However, since the needle felt has low elongation rigidity and experiences a large width shrinkage and a large thickness reduction which occur according to elongation, great tens ion cannot be applied and the needle felt cannot be traveled smoothly. The needle felt has another problem that slippage occurs. When slippage occurs, the abrasion of the traveling surface of the forming belt is promoted, thereby causing such problems as a reduction in service life and the stoppage of a machine due to an increase in power load, which greatly influence productivity.

Since the needle felt cannot be stretched tightly and has low flexural rigidity, it has another problem in that slack can be produced in a portion where there is nothing to support the forming belt, such as between a suction box and a carrying roll because the needle felt cannot bear the weight of the wet material and the wet material can become broken or cracked.

The needle felt has a further problem that it is compressed gradually as it is used, whereby its thickness decreases and its dehydrating power lowers accordingly.

To solve the above problems, an attempt has been made to install an inner belt having rigidity, such as a metal net, on an inner side of the needle felt. This involves an economical problem that the inner belt is additionally required and an apparatus becomes bulky and more expensive. Since the inner belt is present between the needle felt and the suction box, the leak of suction force easily occurs and it is difficult to transmit suction force to the needle felt. Therefore, to carry out a predetermined level of dehydration, the suction pressure of the suction box must be increased or the number of suction boxes must be increased with the result of a reduction in efficiency.

In a transfer belt for manufacturing a construction material which receives and joins together thin wet materials for a construction material formed by the cylinder system sequentially, only the needle felt could be used because of wet material receiving ability in the prior art. However, the transfer belt has a problem that the needle felt is stained by fine particles which get into the needle felt together with water which moves in the felt as in the fordrinier system.

SUMMARY OF THE INVENTION

The present invention has been made, inter alia, to solve the above problems, and others, and it is an object of the present invention to provide a forming belt and/or a transfer belt for manufacturing a construction material which have high yield, high rigidity, cleanability and dehydration properties and to improve the productivity of construction materials using this forming belt for manufacturing a construction material.

In accordance with these and other objects, there is provided a woven net forming belt suitable for use in manufacturing a construction material comprising: monofilament yarn as a weft on a traveling surface side of said belt; yarn in which very small dehydrating space is formed between bundles of plain yarn having a small diameter as a weft on a forming surface side of said belt; and monofilament or monofilament twist yarn as a warp and, wherein said belt includes a plurality of weft layers and at least one warp layer.

In yet further accordance with these and other objects, there are provided methods of making and using woven net forming belts.

Other objects, features and advantages will become apparent by the detailed description which follows.

DETAILED DESCRIPTION OF A PREFERRED EMBODIMENT

Figure 1:
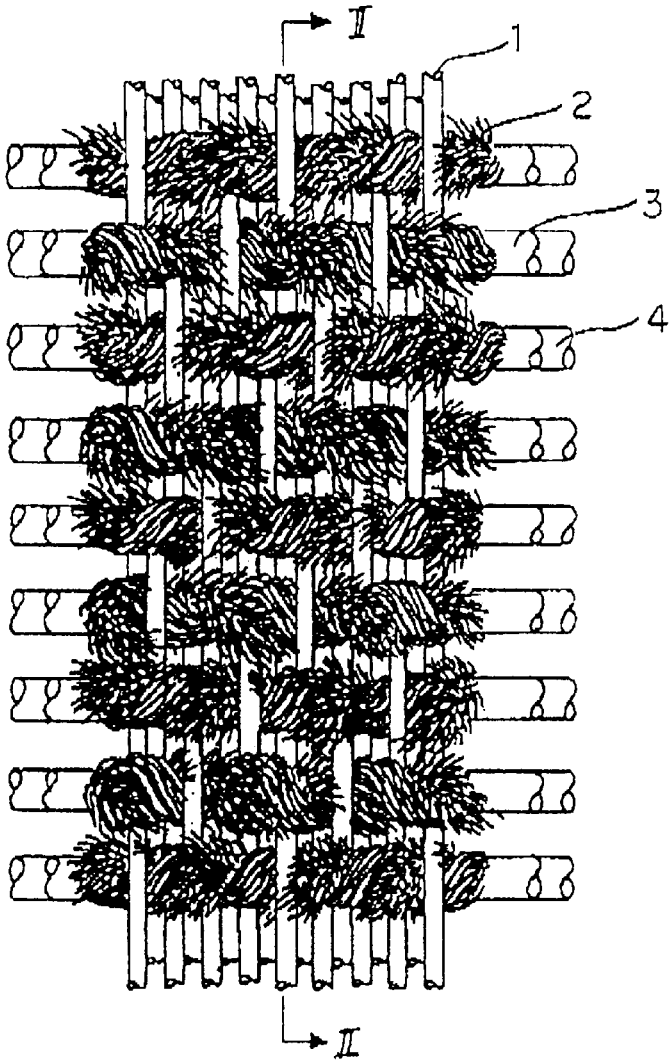
FIG. 1 is a plan view of a forming belt for manufacturing a construction material, according to an embodiment of the present invention.

In the present invention, a fordrinier type forming part is not limited to a fordrinier papermaking machine as generally known in the papermaking field but includes and comprehends all the types of forming parts (even cylinder type forming parts) for forming by stretching a belt between rolls, supplying a slurry onto the belt and dehydrating the slurry while it is carrying it.

The size, consistency, density and other properties of various yarns used in connection with the present invention may vary depending, for example, on the type of construction materials, weaving machines, or weaving type (i.e. single layer wefts, double layer wefts, triple layer wefts, etc.). Suitable diameters for warps may range, for example, from 0.15–1.00 mm, with a density of from 35–180 warps/inch being particularly advantageous. For wefts, suitable diameters for the yarn range for example, from 0.10–1.50 mm, with a density of from 20–250 wefts/inch.

The "very small dehydrating space" as used herein is refers to a bundles of yarn wherein the dehydrating effect thereof is minimized to the greatest extent possible. In fact, the dehydrating space is immeasureable. As used herein, the "bundles of plain yarn having a small diameter" refers to a plurality of very thin yarn (i.e. from 1.0 denir to 15 denir) grouped together; for example, in the case of 540 denir yarn, it may comprise a twisted yarn having (1) 48 4.3 denir yarns set at the center of the twist, and (2) 4 outer yarns, each comprising 24 2.9 denir yarns twisted therearound. Similarly, if 800 denir yarn is used, it could comprise 68 12 denir yarns. Therefore, a very thin yarn would be 2.9 denir (approximately 0.019 mm) in diameter and a larger "thin" yarn would be 12 denir (approximately 0.089 mm) in diameter. The preferred range for the diameter of the plain yarn ranges from about 0.012–0.090 mm.

The present invention relates to a forming belt for manufacturing a construction material which is made from a woven net formed by using monofilament yarn as a weft on a traveling surface side, yarn in which very small dehydrating space is formed between bundles of plain yarn having a small diameter as a weft on a forming surface side and monofilament or monofilament twist yarn as a warp and by arranging a plurality of weft layers and at least a single warp layer.

The forming belt can be formed for example, by using monofilament yarn as a warp on a traveling surface side and monofilament yarn and/or yarn in which very small dehydrating space is formed between bundles of plain yarn having a small diameter as a warp on a forming surface side and by arranging a plurality of weft layers and a single warp layer. The yarn in which very small dehydrating space is formed between bundles of plain yarn having a small diameter can be selected for example, from spun yarn, multifilament yarn, vasing yarn, monofilament twist yarn, chenille yarn, filament processed yarn, yarn formed by winding spun yarn around a monofilament core yarn formed by winding multifilament yarn around a monofilament core and yarn formed by twisting at least two of them together. The forming belt can include an optional intermediate weft layer made of monofilament yarn that is arranged between a weft layer on a traveling surface side and a weft layer on a forming surface side. The intermediate weft layer can be selected for example, from spun yarn, multifilament yarn, rasing yarn, monofilament twist yarn, chenille yarn, filament processed yarn, yarn formed by winding spun yarn around a monofilament core, yarn formed by winding multifilament yarn around a monofilament core and yarn formed by twisting at least two of them together. The intermediate layer can be arranged between a weft layer on a traveling surface side and a weft layer on a forming surface side. Alternatively, the optional intermediate weft layer can be selected for example, from monofilament spun yarn, multifilament yarn, raining yarn, monofilament twist yarn, chenille yarn, filament processed yarn, yarn formed by winding spun yarn around a monofilament core, yarn formed by winding multifilament yarn around a monofilamont core and yarn formed by twisting at least two of them together, and can be arranged between a weft layer on a traveling surface side and a weft layer on a forming surface side.

The present invention is also directed to a transfer belt for manufacturing a construction material for receiving wet materials formed by a forming part and joining them together sequentially, which is made from a woven net formed by using monofilament yarn as a weft on a traveling surface side, yarn in which yarn in which very small dehydrating space is formed between bundles of plain yarn having a small diameter as a weft on a forming surface side and monofilamnent or monofilament twist yarn as a warp and by arranging a plurality of weft layers and a single warp layer. The transfer belt for manufacturing a construction material can be a belt for receiving wet materials formed by a cylinder type forming machine for manufacturing a construction material sequentially, joining them together and sending them to the next pressing part.

In a forming belt for manufacturing a construction material, dehydrating space should be very small to reduce the leakage of a raw material and obtain a wet material having a large weight. However, as a structure such as felt or the like has various problems as described above, the present invention forms a multi-functional fabric which has a woven network structure without using a vatt, prevents the leakage of a raw material from a slurry to improve yield by forming very small dehydrating space densely on a forming surface side. These effects are achieved, for example, by weaving yarn having a very small dehydrating space on the forming surface side, such as spun yarn, multifilament yarn, rasing yarns monofilament twist yarn, chenille yarn, filament processed yarn, yarn formed by winding spun yarn around a monofilament core, yarn formed by winding multifilament yarn around a monofilament core, yarn formed by twisting at least two of them or the like, and/or by using a belt that has a network structure on a traveling surface side formed from mainly monofilament yarn (i.e. more than 50% by weight) to ensure solid space through which a cleaning shower can easily run so as to improve cleanability and rigidity.

"Spun yarn" as used herein means yarn formed by binding short fibers into yarn, such as spun yarn or the like; "multifilament yarn" means yarn formed by binding fine single fibers into yarn; "rasing yarn" means yarn formed by scratching the surface of a multifilament with a needle-like object to nap it; "filament processed yarn" means yarn formed by stretching, bulking or crimping filament yarn and including yarn called textured yarn, bulky yarn and stretch yarn as well as woolly nylon yarn and the like; "chenille yarn" means yarn formed by arranging short fibers radially around core yarn such as multifilament yarn and including yarn formed by crimping short fibers arranged radially.

Solid space on the traveling surface may constitute large dehydrating space and hence, has excellent dehydrating properties in spite the fact that the leakage of a raw material is small. A reduction in dehydrating properties is small and excellent dehydrating properties can be maintained until the end of use because even when the traveling surface wears out and monofilament yarn is chipped, only the solid space is slightly reduced and the plane space remains unchanged. Since felt is filled with fine synthetic fiber vatts to the rear side and there is no large dehydrating space, it has poor dehydrating properties. Therefore, when the traveling surface is rubbed and wears out, stains are accumulated between fine fibers, thereby further deteriorating dehydrating properties.

In the present invention, as the traveling surface preferably has a monofilament network structure, the elongation rigidity and flexural rigidity of a woven fabric become very high compared with a needle felt, whereby great tension can be applied to stretch the belt tightly and drive roll force can be transmitted without fail, thereby making it possible for the belt to travel smoothly and prevent slippage.

In accordance with the present invention, it is possible for there to be no slack even in a portion where there is nothing to support a forming belt, between a suction box and a carrying roll of the belt, because the belt can bear the weight of wet material, and the wet material is not broken or cracked. Further, there can be obtained a secondary effect that an apparatus such as a bulky stretcher or tentering roll is not required.

A reduction in thickness at the time of use or during use is very small and is often minimized. The needle felt is compressed gradually as it is used, whereby its thickness decreases and its dehydrating power lowers accordingly. However, since the present invention has high rigidity as a woven net, a reduction in its thickness is small and its high dehydrating power can be maintained until the end of its use.

As for high pressure washing shower resistance, yarn forming the surface of the forming belt for manufacturing a construction material of the present invention is preferably an aggregate of fine fibers like the vatt of the needle felt and yet has a woven network structure as a whole that wefts are interwoven with warps and warps are interwoven with wefts in a short cycle and tightly bound to each other. Therefore, the yarn is not cut or does not fall off by the impact of shower water. This high pressure shower resistance can be obtained by making the forming surface a woven network structure.

As described above, unlike needle felt, the forming belt of the present invention does not have such a structure that fine fibers are crowded in the whole direction of the z axis but a structure wherein an aggregate of fine fibers is formed on the forming surface alone and tightly bound to the forming surface, whereby stains are hardly accumulated. Even when it is stained, it can be completely washed with a low-pressure shower which in general cannot clean needle felt.

As for weave structure, the warp preferably has a monofilament or monofilament twist yarn layer and the weft is preferably yarn in which a very small dehydrating space is formed between bundles of plain yarn having a small diameter on the forming surface sides Any weave structure is acceptable if multiple layers are formed in such a manner that monofilament yarn is arranged on the traveling surface side, as exemplified by double-layer structures such as single warp/double wefts, single warp/triple wefts, double warps/triple wafts and double warps/double wefts, and the like.

A layer of monofilament or monofilament twist yarn is preferably employed as a warp since its use serves to improve rigidity and dimensional stability while the use of a monofilament weft on the traveling surface side serves to improve rigidity and abrasion resistance.

The material of the yarn is not particularly limited but a synthetic fiber such as a polyester, polyamide or polyphenylene sulfide, chemical fiber such as rayon, natural fiber such as cotton or the like may be used.

When the weft on the traveling surface side is made from a polyamide, high abrasion resistance is achieved and when it is made from a polyester, rigidity is increased. Therefore, when importance is attached to rigidity, a polyester is expediently used. In view of balance between rigidity and abrasion resistance, a polyamide and a polyester can be used simply, in combination, and/or as alternate layers.

When the warp is made double-layered, monofilament yarn can be used for the traveling surface side and yarn in which very small dehydrating space is formed between bundles of plain yarn having a small diameter can be used for the forming surface side. Monofilament yarn on the traveling surface side is used to improve mainly rigidity and dimensional stability and yarn in which very small dehydrating space is formed between bundles of plain yarn having a small diameter is used to reduce the leak of a raw material and enhance yield.

Monofilament yarn and the same intermediate weft layer as that on the forming surface side can optionally be arranged between the forming surface side and the traveling surface side of the weft to improve yield if desired for any reason.

When rigidity is to be further improved according to required conditions, monofilament yarn can be arranged as an intermediate layer to increase rigidity and when yield is to be further improved, the same yarn in which very small dehydrating space is formed between bundles of plain yam having a small diameter as that on the forming surface side can be arranged as an intermediate layer. Intermediate performance can be obtained by arranging monofilament yarn and a bundle of plain yarn having a small diameter alternately.

Preferred embodiments of the present invention will be described with reference to the accompanying drawings.

Figure 2:
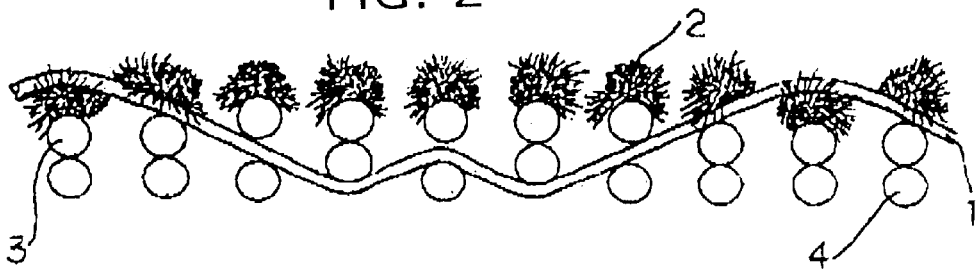
FIG. 2 is a sectional view cut on line II—II of FIG. 1 along the warp.

FIG. 1 is a plan view of a forming belt for manufacturing a construction material according to an embodiment of the present invention and FIG. 2 is a sectional view cut on line II—II of FIG. 1 along the warp.

This embodiment is an 8-shaft single warp/triple weft forming belt for manufacturing a construction material in which polyamide monofilament yarn having a diameter of 0.35 mm is used as a warp 1 at a density of 90/cm, yarn formed by twisting together polyamide rasing yarn of 540 denier and polyamide multifilament crimped yarn of 800 denier is used as a weft 2 on the forming surface side at a density of 28/inch, polyester monofilament yarn having a diameter of 0.45 mm is used as an intermediate layer weft 3 at a density of 28/inch, and polyamide monofilament yarn and polyester monofilament yarn having a diameter of 0.40 mm are used as a weft 4 on the traveling surface side at a density of 14/inch.

Figure 3:
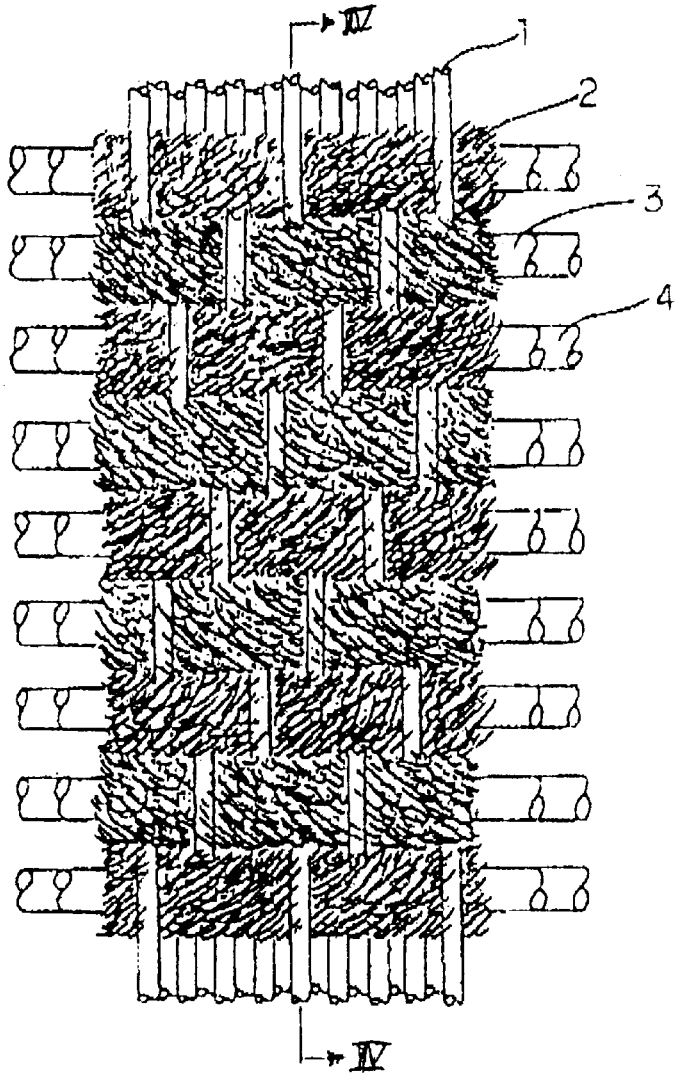
FIG. 3 is a plan view of a forming belt for manufacturing a construction material according to an embodiment of the present invention.
Figure 4:
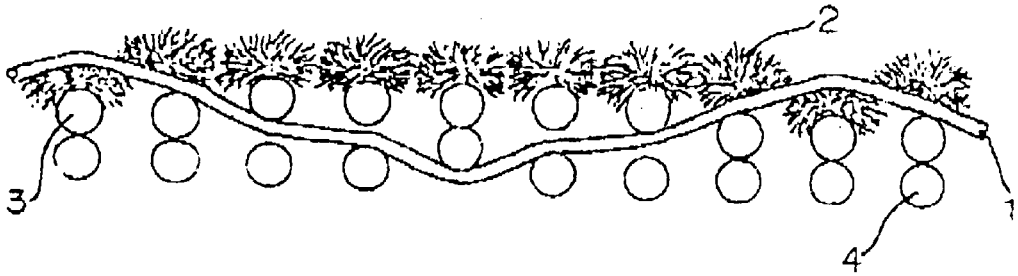
FIG. 4 is a sectional view out on line IV—IV of FIG. 3 along the warp.

FIG. 3 is a plan view of a forming belt for manufacturing a construction material according to an embodiment of the present invention and FIG. 4 is a sectional view cut on line IV—IV of FIG. 3 along the warp.

This embodiment is an 8-shaft single warp/triple weft 6 forming belt for manufacturing a construction material, in which polyester monofilament yarn is used as a warp 1, polyamide spun yarn is used as a weft 2 on the forming surface side, and polyamide monofilament yarn is used as an intermediate layer weft 3 and a weft 4 on the traveling surface side.

Figure 5:
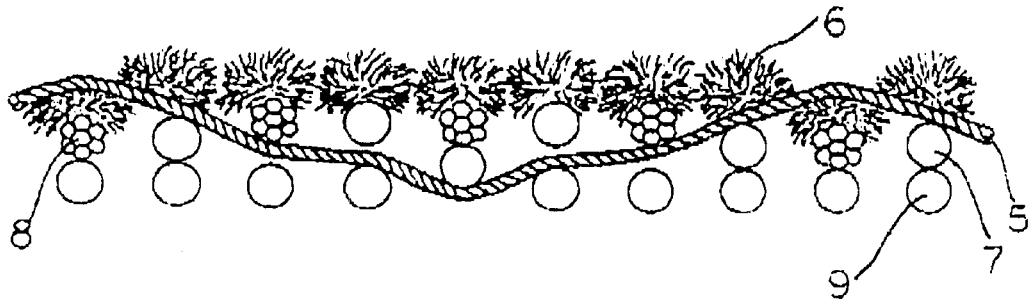
FIG. 5 is a sectional view of a forming bolt for manufacturing a construction material according to another embodiment of the present invention along the warp.

FIG. 5 is a sectional view of a forming belt for manufacturing a construction material according to another embodiment of the present invention along the warp.

This embodiment is an 8-shaft triple weft forming belt for manufacturing a construction material in which polyester monofilament twist yarn is used as a warp 5, polyamide spun yarn is used as a weft 6 on the forming surface side, an intermediate layer weft 7 which is polyamide monofilament twist yarn and a polyamide monofilament intermediate layer weft 8 are used alternately as an intermediate layer weft, and polyamide monofilament yarn is used as a weft 9 on the traveling surface side.

Figure 6:
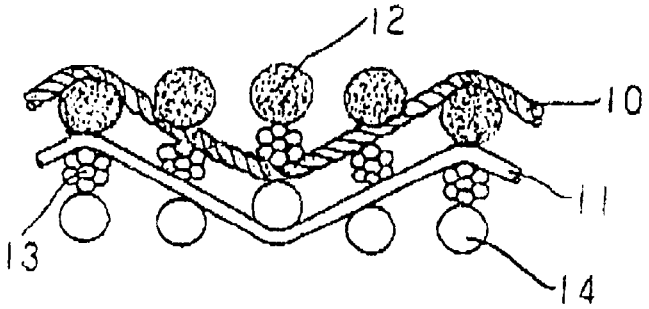
FIG. 6 is a sectional view of a forming belt for manufacturing a construction material according to still another embodiment of the present invention along the warp.

FIG. 6 is a sectional view of a forming belt for manufacturing a construction material according to still another embodiment of the present invention along the warp. This embodiment is an 8-shaft double warp/triple weft forming belt for manufacturing a construction material in which polyamide multifilament yarn is used as a warp 10 on the forming surface side, polyester monofilament yarn is used as a warp 11 on the traveling surface side, polyamide multifilament yarn is used as a weft 12 on the forming surface side, polyamide monofilament twist yarn is used as an intermediate layer weft 13 and polyamide monofilament yarn is used as a weft 14 on the traveling surface side.

Figure 7:
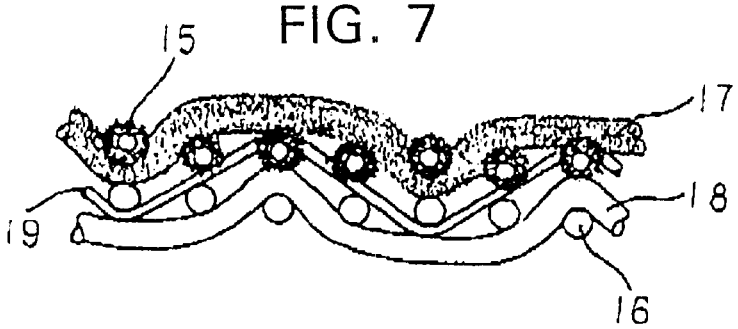
FIG. 7 is a sectional view of a forming belt for manufacturing a construction material according to a further embodiment of the present invention along the weft.

FIG. 7 is a sectional view of a forming belt for manufacturing a construction material according to a further embodiment of the present invention along the weft.

This embodiment is a forming belt for manufacturing a construction material which is an 8-shaft double warp/double weft double-layer fabric woven in which yarn formed by winding polyamide spun yarn around polyester monofilament core yarn is used as a weft 15 on the traveling surface side, polyester monofilament yarn is used as a warp 16 on the traveling surface side, woolly polyamide monofilament yarn is used on a weft 18 on the traveling surface side and polyamide nylon yarn is used as a weft 17 on the forming surface side, monofilament yarn is used as connecting yarn 19.

Figure 8:
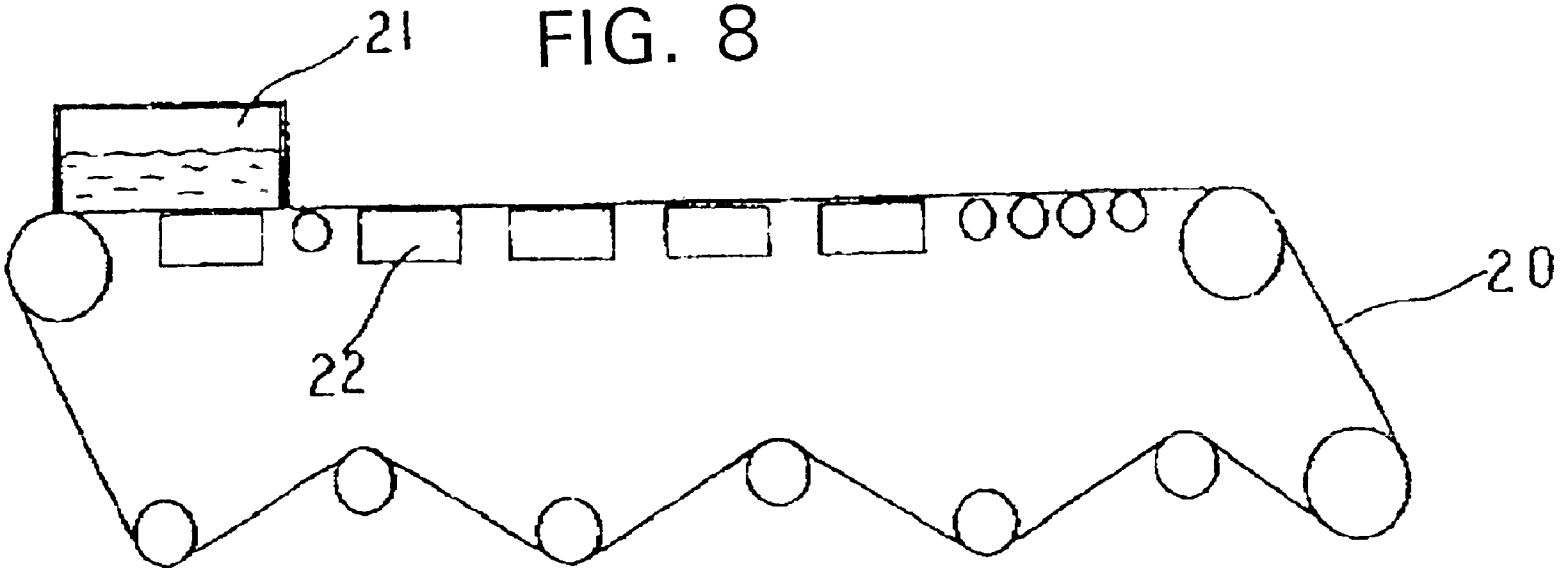
FIG. 8 is a schematic diagram showing an example of a papermaking machine using the forming belt for manufacturing a construction material of the present invention.

FIG. 8 is a diagram for explaining a machine for manufacturing a construction material using the forming belt 20 for manufacturing a construction material of the present invention. In FIG. 8, a slurry supplied from a slurry box 21 is dehydrated by a suction box 22 and formed while it is carried by the forming belt 20 for manufacturing a construction material, and the obtained wet material is supplied to the next pressing part. Since the belt 20 for manufacturing a construction material of the present invention has excellent rigidity, it is generally not necessary to use an inner belt or install a bulky stretcher, thereby making it possible to design a compact machine.

Figure 9:
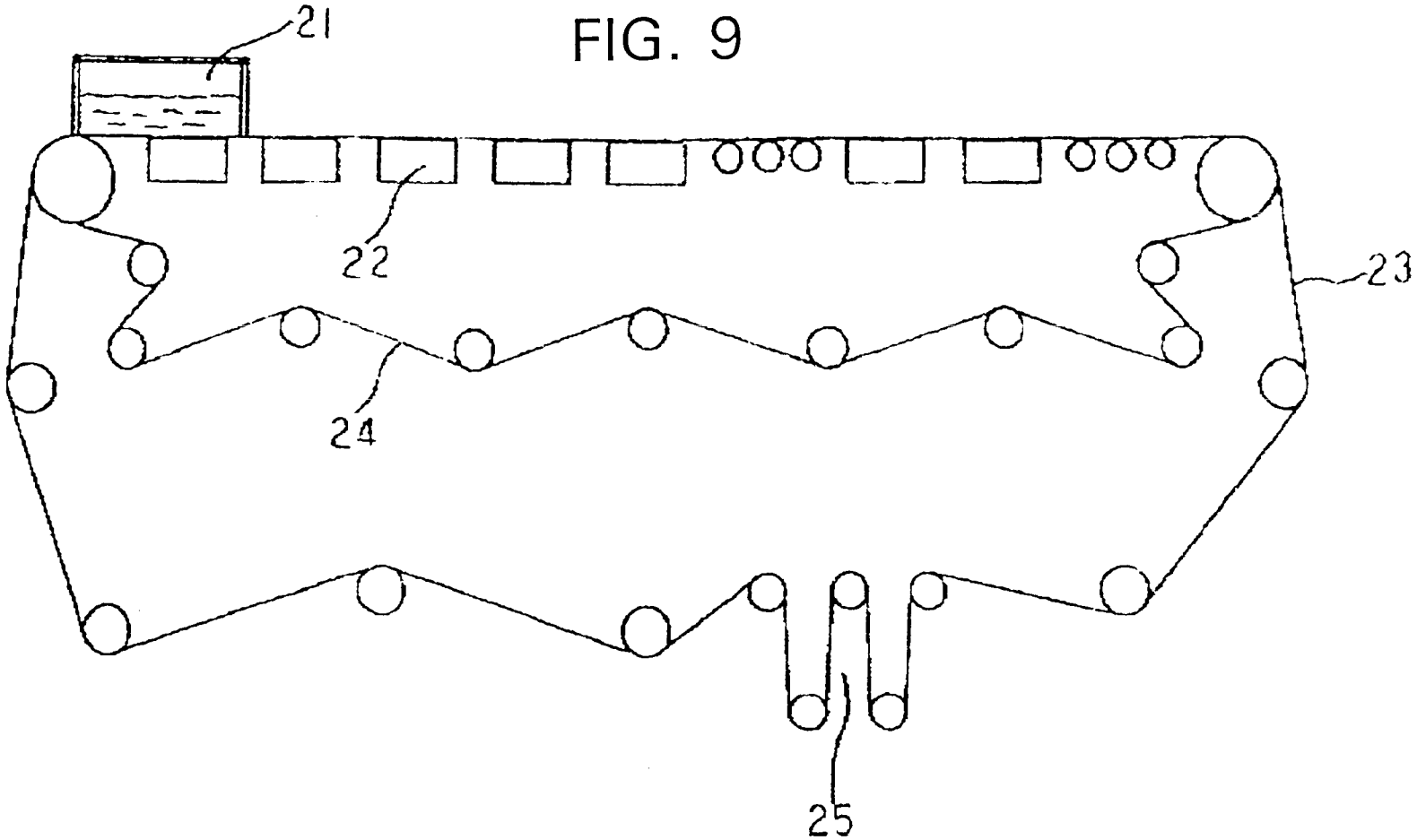
FIG. 9 is a schematic diagram showing another example of a papermaking machine using the forming belt for manufacturing a construction material.

FIG. 9 is a diagram for explaining another machine for manufacturing a construction material in which an inner belt 24 is used on an inner side of a needle felt 23 which is a forming belt for manufacturing a construction material. The inner belt 24 is installed on an inner side of the needle felt 23, and is stretched tightly with great tension applied thereto. The inner belt 24 travels with roll drive force that it receives constantly or without fail, whereby the needle felt 23 which is in contact with an upper part of the inner belt 24 travels along with the inner belt 24. A metal net having excellent rigidity is used as the inner belt 24. The inner belt 24 also serves to prevent slack in the needle belt 23 between other suction box 22 and the carrying roll in addition to the transmission of drive force. A stretcher 25 must be installed for the needle felt 23 because it is easily extended.

Since the inner belt 24 is installed, this machine has a problem or defect in that it is bulky compared with a machine for manufacturing a construction material which uses a forming belt of the present invention.

The forming belt for manufacturing a construction material of the present invention provides the most excellent effects when it is used in a fordrinier type forming machine for manufacturing a construction material. However, the forming belt for manufacturing a construction material of the present invention is not limited to this. It may be used in a cylinder type forming machine for manufacturing a construction material and as a belt for receiving and joining wet materials together and supplying the resulting product to the next pressing part.

The effect of the present invention will be described by carrying out a comparison test on a forming belt for manufacturing a construction material according to an embodiment of the present invention and a needle felt as the prior art.

The forming belt for manufacturing a construction material shown in FIGS. 1 and 2 is used as example of the present invention and the conventional needle felt shown below is used as Comparative Example.

COMPARATIVE EXAMPLE

A needle felt formed by needling polyamide vatts on a base woven of polyamide monofilament twist yarn as a warp and polyamide monofilament twist yarn as a weft at a density of 2.2 kg/m$^2$.

Comparison Test

1. Rigidity

1) Elongation

Elongation and break strength at a tension of 7 kg/cm and a tension of 14 kg/cm when dry and wet are compared. The results are shown in Table 1.

2) Bending

Bending resistances in longitudinal and transverse directions are compared (measured using the Taber stiffness tester of Kumagaya Riki Kogyo Co., Ltd. which is incorporated herein by reference)

Example: 38.5 g-cm in a longitudinal direction and 139.7 g-cm in a transverse direction Comparative Example: 18.4 g-cm, in a longitudinal direction and 14.7 g-cm in a transverse direction 2. Shower Resistance Example and Comparative Example were placed on a frame and exposed to a high-pressure shower under the following conditions. Durability against shower was investigated.

shower pressure: 20, 30 kg/cm$^2$ nozzle: diameters 1 mm distance: 100 mm sliding distance: 50 mm in warp direction; 50 mm in weft direction sliding speed: 50 mm/30 sec in warp direction, 50 mm/7 sec in weft direction A large hole was formed in Comparative Example in 30 minutes with a shower pressure of 20 kg/cm$^2$ whereas slight napping occurred in 30 minutes in Example but no hole or no broken yarn was seen.

At a shower pressure of 30 kg/cm$^2$, a hole was formed before one cycle in Comparative Example whereas slight napping occurred in 10 minutes in Example but no hole or broken yarn was seen.

3. Nip Resistance

A sample was sandwiched between two rolls and slid while a nip was applied under the following conditions. The fibrillation and collapse of yarn were judged.

tension: 2.5 kg/cm nip roll: ϕ40 mm×2 (made from steel plated with chromium) nip condition: dry, 15 kg/cm stroke: 100 mm sliding speed: 50 times/mm number of sliding times: 15,000 in both directions Almost no change in appearance was seen in Comparative Example but the thickness decreased by 40.64%.

In Example, no fibrillation occurred and yarn formed by twisting together polyamide multifilament rasing yarn and polyamide multifilament crimped yarn as a weft on the forming surface side was slightly collapsed and made flat. The thickness decreased by8.4%.

It is understood from the results of the above test that the forming belt for manufacturing a construction material of the present invention is advantageous over and superior to the needle felt in rigidity, shower resistance and nip resistance.

TABLE 1

| | Example | Comparative Example |
|---|---|---|
| Vertical direction | | |
| When dry | | |
| Elongation at 7 kg/cm (%) | 1.7 | 3.9 |
| Elongation at 14 kg/cm (%) | 3.8 | 6.4 |
| Elongation at break (%) | 25.6 | 57.4 |
| Break strength (kg/cm) | 12.7 | 181.6 |
| When wet | | |
| Elongation at 7 kg/cm (%) | 2.3 | 5.5 |
| Elongation at 14 kg/cm (%) | 5.0 | 8.0 |
| Elongation at break (%) | 30.3 | 55.2 |
| Break strength (kg/cm) | 137.2 | 163.0 |
| Horizontal direction | | |
| When dry | | |
| Elongation at 7 kg/cm (%) | 0.9 | 23.5 |
| Elongation at 14 kg/cm (%) | 2.3 | 33.8 |
| Elongation at break (%) | 41.7 | 51.5 |
| Break strength (kg/cm) | 127.5 | 39.0 |

TABLE 1-continued

| | Example | Comparative Example |
|---|---|---|
| When wet | | |
| Elongation at 7 kg/cm (%) | 0.9 | 23.1 |
| Elongation at 14 kg/cm (%) | 2.5 | 31.8 |
| Elongation at break (%) | 38.4 | 47.6 |
| Break strength (kg/cm) | 107.5 | 79.5 |

The forming belt for manufacturing a construction material of the present invention rarely experiences the leakage of a raw material, carries out forming in good yield and has excellent dehydrating properties.

Since the belt has excellent rigidity, it does not have to use an inner belt or the like and does not crack or break a wet material.

Since it has excellent shower resistance and enables cleaning with a high-pressure shower, stains can be removed easily, thereby making it possible to increase forming speed.

Further, since it has excellent abrasion resistance, nip resistance and a small reduction in thickness, even when it is used for a long time, it can maintain excellent dehydrating properties until the end of its use.

Use of this forming belt for manufacturing a construction material having excellent rigidity, cleanability, dehydrating properties and abrasion resistance makes it possible to improve the productivity of construction materials which is the ultimate object of the present invention.

As used herein, the singular terms such as "a", "an" and "the" shall encompass either the singular or plural of the object which follows.

The priority document, JP 9-306286 filed Oct. 3, 1997 is incorporated herein in its entirety by reference including the title, specification, claims, abstract and figures.

Publicly available specifications for all products and test protocols mentioned herein are incorporated by reference in their entirety.

We claim:

1. A woven net forming belt suitable for use in manufacturing a construction material comprising:

monofilament yarn as a weft on a traveling surface side of said belt;

yarn in which a dehydrating space is formed between bundles of plain yarn as a weft on a forming surface side of said belt; and monofilament or monofilament twist yarn as a warp, wherein said belt includes a plurality of weft layers and at least one warp layer.

2. A woven net forming belt according to claim 1, which is formed by using monofilament yarn as a warp on a traveling surface side and monofilament yarn and/or yarn in which a dehydrating space is formed between bundles of plain yarn as a warp on a forming surface side and which is formed by arranging a plurality of said weft layers and a plurality of said warp layers.

3. A woven net forming belt according to claim 1, wherein the yarn in which the dehydrating space is formed between bundles of plain yarn is selected from the group consisting of spun yarn, multifilament yarn, rasing yarn, monofilament twist yarn, chenille yarn, filament processed yarn, yarn formed by winding spun yarn around a monofilament core, yarn formed by winding multifilament yarn around a monofilament core and yarn formed by twisting at least two yarns together.

4. A woven net forming belt according to claim 1, wherein an intermediate weft layer made of monofilament yarn is arranged between a weft layer on a traveling surface side of the belt and a weft layer on a forming surface side of the belt.

5. A woven net forming belt according to claim 1, further comprising an intermediate weft layer selected from the group consisting of spun yarn, multifilament yarn, rasing yarn, monofilament twist yarn, chenille yarn, filament processed yarn, yarn formed by winding spun yarn around a monofilament core, yarn formed by winding multifilament yarn around a monofilament core and yarn formed by twisting at least two yarns together that is arranged between a weft layer on a traveling surface side of the belt and a weft layer on a forming surface side of the belt.

6. A woven net forming belt according to claim 1, further comprising an intermediate weft layer made of monofilament yarn and selected from the group consisting of monofilament spun yarn, multifilament yarn, rasing yarn, monofilament twist yarn, chenille yarn, filament processed yarn, yarn formed by winding spun yarn around a monofilament core, yarn formed by winding multifilament yarn around a monofilament core and yarn formed by twisting at least two yarns together that is arranged between a weft layer on a traveling surface side of the belt and a weft layer on a forming surface side of the belt.

7. A woven net forming belt according to claim 1, wherein said wefts have a diameter from 0.10–1.50 mm and a density of 20–250 wefts/inch, and said warps have a diameter of from 0.15–1.00 mm and a density of 35–180 warps/inch.

8. A transfer belt for manufacturing a construction material capable of receiving wet materials formed by a forming part and joining at least two of said construction materials together sequentially, said belt comprising a woven net formed by using i) monofilament yarn as a weft on a traveling surface side of said belt, ii) yarn having dehydrating space formed between bundles of plain yarn as a weft on a forming surface side of said belt, and iii) monofilament or monofilament twist yarn as a warp, and wherein a plurality of weft layers and at least single warp layer are arranged in said woven net.

9. A woven net belt, comprising:

at least one belt surface comprising an aggregate of fibers, an intermediate layer, and a woven network structure which as a whole makes up for a remainder of said belt, wherein wefts are interwoven with warps and warps are interwoven with wefts in a cycle, wherein said intermediate layer is a weft layer selected from the group consisting of spun yarn, multifilament yarn, rasing yarn, monofilament twist yarn, chenille yarn, filament processed yarn, yarn formed by winding spun yarn around a monofilament core, yarn formed by winding multifilament yarn around a monofilament core and yarn formed by twisting at least two yarns together that is arranged between a weft layer on a traveling surface side of the belt and a weft layer on a forming surface side of the belt.

10. A method for preparing a woven net forming belt, comprising:

providing a woven network structure wherein wefts are interwoven with warps and warps are interwoven with wefts in a cycle, that is attached to an intermediate layer, that is attached to at least one surface layer comprising an aggregate of fibers, wherein said intermediate layer is a weft layer selected from the group consisting of spun yarn, multifilament yarn, rasing yarn, monofilament twist yarn, chenille yarn, filament processed yarn, yarn formed by winding spun yarn around a monofilament core, yarn formed by winding multifilament yarn around a monofilament core and yarn formed by twisting at least two yarns together that is arranged between a weft layer on a traveling surface side of the belt and a weft layer on a forming surface side of the belt.

11. A woven net belt, comprising:

at least one belt surface comprising an aggregate of fibers, an intermediate layer, and a woven network structure which as a whole makes up for a remainder of said belt, wherein wefts are interwoven with warps and warps are interwoven with wefts in a cycle, wherein said intermediate layer is a weft layer made of monofilament yarn and selected from the group consisting of monofilament spun yarn, multifilament yarn, rasing yarn, monofilament twist yarn, chenille yarn, filament processed yarn, yarn formed by winding spun yarn around a monofilament core, yarn formed by winding multifilament yarn around a monofilament core and yarn formed by twisting at least two yarns together that is arranged between a weft layer on a traveling surface side of the belt and a weft layer on a forming surface side of the belt.

12. A method for preparing a woven net forming belt, comprising:

providing a woven network structure wherein wefts are interwoven with warps and warps are interwoven with wefts in a cycle, that is attached to an intermediate layer, that is attached to at least one surface layer comprising an aggregate of fibers, wherein said intermediate layer is a weft layer made of monofilament yarn and selected from the group consisting of monofilament spun yarn, multifilament yarn, rasing yarn, monofilament twist yarn, chenille yarn, filament processed yarn, yarn formed by winding spun yarn around a monofilament core, yarn formed by winding multifilament yarn around a monofilament core and yarn formed by twisting at least two yarns together that is arranged between a weft layer on a traveling surface side of the belt and a weft layer on a forming surface side of the belt.

* * * * *